United States Patent [19]

Roye

[11] 4,195,886

[45] Apr. 1, 1980

[54] RADIAL MINING METHOD

[76] Inventor: Henry L. Roye, 801 NW. Third, Stigler, Okla. 74462

[21] Appl. No.: 875,298

[22] Filed: Feb. 6, 1978

Related U.S. Application Data

[63] Continuation-in-part of Ser. No. 761,797, Jan. 24, 1977, Pat. No. 4,072,351.

[51] Int. Cl.[2] ..... E21C 41/00

[52] U.S. Cl. ..... 299/11; 98/50; 299/12; 299/18; 299/19

[58] Field of Search ..... 299/11, 12, 18, 19

[56] References Cited

U.S. PATENT DOCUMENTS

| | | | |
|---|---|---|---|
| 3,975,053 | 8/1976 | Kochanowsky | 299/18 X |
| 4,007,966 | 2/1977 | Wenneborg | 299/11 |
| 4,072,351 | 2/1978 | Roye | 299/12 X |

*Primary Examiner*—Ernest R. Purser
*Attorney, Agent, or Firm*—Head & Johnson

[57] ABSTRACT

A method of mining a large underground seam of mineral, such as coal is described in which a first cylindrical shaft is drilled from the surface of the earth down to the mineral seam. A portion is enlarged at the base of the first shaft as a work room. A first radial shaft in the seam, out to a selected radius R, is drilled by conventional methods with the roofs supported by means such as hydraulic chocks which can be extended and moved selectively as the line of drilling progresses. When the first shaft is drilled, a continuous miner working on a short face method of mining is directly radially from the work room and is advanced outwardly until the width of the first radial shaft is such that the original wall of the first shaft has been cut away. The direction of the miner is then turned to be parallel to the first horizontal shaft and a short wall cutting advance is made to cut away the first wall of the first shaft and, in effect, drill a second shaft having a first wall spaced by the width of the cutter. A continuous flexible curtain is provided between the floor and roof, on the back side of the chocks, so that fresh air can be brought down through the vertical shaft and radially outward along the working face and back on the outside of the flexible curtain toward the working room and up to the surface in a second vertical or slope shaft. By widening the first shaft so that the second wall is at an angle to the first shaft, a circular area is cut out. If the second wall is parallel to the first wall, a rectangular area is cut out. Access to the work area can be from the surface, from a horizontal shaft or from an outcrop or in the case of an existing mine, access from shafts already available.

20 Claims, 9 Drawing Figures

RADIAL MINING METHOD

CROSS-REFERENCE TO RELATED APPLICATION

This application is a continuation-in-part of my co-pending application, Ser. No. 761,797, filed January 24, 1977, entitled "Radial Mining Method", now U.S. Pat. No. 4,072,351. Application Ser. No. 761,797 is incorporated into this application by reference.

BACKGROUND OF THE INVENTION

1. Field of the Invention

This invention lies in the field of mineral mining. More particularly, it is concerned with a system of mineral mining in which a working shaft is provided which is started regularly from the bottom of a vertical or slope shaft, extending from the surface to the mineral seam. A wall in a mineral stratum is cut away by any selected mining techniques, and the working face is advanced until at least a large circular or rectangular portion of the seam is removed.

2. Description of the Prior Art

In the prior art many systems of mining minerals, such as coal, have been advanced. Elaborate mining machinery has been developed such as the continuous miner which can cut a short wall equal to the width of its cutting cylinder, or sidewall cutters which can advance along the long wall. However, the subsurface is generally worked by a room and pillar method or a number of parallel horizontal shafts are first drilled by conventional methods and wide sections are cut back by a long wall, short wall, auger and/or other conventional methods.

There are a number of ways in which improvements can be made in these types of operations, such as roof falls, complete recovery, fresh air, shortest route, fire and maintenance. One of them involves the great length of roadway and transport that is required to bring in supplies and carry out minerals from the working face to the mouth of the mine, which is greatly reduced by this invention.

Another is the matter of delivery of clean air to the working face, and recovery of contaminated air by a separate route.

Furthermore, the national average for recovery of these minerals is between 50% and 70% of the in-place material, while with this method the recovery can be virturally 100%. The reason for the poor recovery by conventional methods is because the material which is left cannot be recovered without excessive cost and/or endangering life such as by roof falls.

In the prior art systems there is great difficulty and expense in maintaining a safe roof, so that it does not fall and kill people, or cave in from the side. A consequence of the prior art systems is that the entire roof must be supported for the life of the mine since succeeding production is delivered through the areas of prior production.

In this invention, as soon as a long wall is advanced a selected distance, the roof supporting means are moved to an adjacent position, permitting the roof to cave, since there is no transport of material or personnel through that area.

And finally, there is the problem of maintenance of the roof, of the mine proper, of the transport means and transport routes, electrical power, water, track, gas buildup, etc. Since all these routes are shortened in this invention, the maintenance is greatly simplified.

The conventional methods of mining have great fire hazards due to dust, spontaneous combustion, dead air spaces, worn or frayed electrical cables or other electrical equipment, etc. In this system, the ventilation system is short and direct, permitting more rapid and complete changes of air.

SUMMARY OF THE INVENTION

It is a primary object of this invention to provide a method of mining an underground mineral seam with the shortest access and length of supply and delivery lines, and full control of all material and equipment.

It is a further object of this invention to provide a system of mining in which air can be introduced in one or more conventional vertical or slope shafts dug to the depth of the mineral seam, or by horizontal shafts or by open cut surface area, whereby it will flow radially out along a horizontal shaft to the working face and the entire involved work area, out to the limits, at a radius R of the mining operation, and back through a separate channel along the back side of a flexible curtain, to the axis of the underground operation and up to the surface through the same, or a second vertical shaft drilled from the surface, etc.

It is a further object of this invention to provide a method of underground mining with short access and delivery routes.

It is a still further object of this invention to provide a method of underground mining that uses a minimum roof support, and in which this limited roof support is continuously moved to support the new roof at the working face, and to expose the old roof behind the roof supports, and permit the old roof to slump or cave.

It is a still further object of this invention to provide a method of underground mining in which a novel circulation system of fresh air is provided along the shaft from which the face is being worked, and then back of a roof-to-floor flexible curtain closure mounted back of the roof supports, to the atmosphere.

These and other objects are realized and the limitations of the prior art are overcome in this invention by providing access to an underground work area by vertical or slope shaft from the surface, or horizontal shaft from an outcrop, or from the surface by open cut.

While any means of access can be provided to a work area, positioned about at the level of the mineral seam at a selected point, the method will be described first as in said co-pending application, by having access from the surface through a vertical or slope shaft.

The vertical or sloping shaft is large enough for men and equipment to be lowered. A workroom or work space is created at the base of the vertical shaft, wherein equipment can be assembled and where mined minerals and waste rock, etc. are continuously carried to the surface. A second and/or third shaft may be drilled, or conduits provided through which fresh air can be brought down the main shaft and radially along a working shaft to the outer margin of the work area, and contaminated air carried to the surface by a separate flow path.

The process works a given area of the mineral seam which is circular and has a selected radius R which may be the order of hundreds or thousands of feet or more as selected, or rectangular, as desired.

A first radial shaft is drilled in any desired direction from the workroom at the base of the first central vertical shaft, radially outward to a selected radius R, by any selected means. As the shaft is drilled, the roof is supported by movable supports spaced along the shaft. These supports are preferably hydraulic chocks, which are positioned as the shaft is advanced, there being space beneath the chocks for the men and equipment to move to and from the working face. Some suitable means of carrying the mined material, such as coal, rock, mineral ore, etc. back to the central shaft, such as a conveyor belt, etc. is provided.

In cutting the first radial shaft, consider that the shaft is to be rotated in increments of angle A in any direction, such as counterclockwise, in which, facing radially outward, the left wall will be cut away to advance the working face. The left, or first wall, becomes a long wall which can be mined in a more or less conventional long wall manner, or by using a continuous miner cutting a selected width of shaft or by any selected method of mining. A second shaft is directed counterclockwise, for example, of the first shaft, by the angle A and is advanced until the width of the second shaft equals the width of the cutter. The second shaft is then directed substantially parallel to the first wall of the first shaft, until the cut advances out to the radius R. The mining machine can then be returned to the start of the first wall, or the cut can be made while advancing inwardly from the radius R toward the center.

The roof supports could be conventional props and timber along the main entry to the center of the work area. However, in the radial shaft, because of the rapid advance of the wall and for rectangular cuts, hydraulic roof supports are much more efficient. The direction of extension of the hydraulic chocks will be toward the first wall, which is to be cut away.

As the continuous miner advances, the hydraulic roof supports, or chocks, are extended to cover the new roof area cleared by the mining machine. Then, as neccessary the chocks themselves are moved in the direction of the advance of the long wall. The roof being exposed by the continuous miner is continuously protected. Correspondingly after the long wall has moved a selected distance, a portion of the old roof will be unsupported and will slump or cave.

When the continuous miner reaches the maximum radius R, it is returned down the second shaft to the first point of departure, where it changes angle and is redirected in the direction of angle A radially and advances until a third face is cut, and the miner is again rotated to be parallel to the second face of the second shaft, and then it again proceeds out to the radius R and so on.

When a continuous sector of the circular area to be cut has been completed, the continuous miner is again returned to the center at the workroom and directed at a new angle which is equal to 2A, compared to the radial direction of the first shaft, and it proceeds radially outward and then turns parallel to the third wall and so on as was previously done. The important thing is that as the miner advances outwardly, the roof supports are extended so that they cover the new roof at the new long wall face being formed. As the continuous miner is brought back to an intermediate or starting point, the roof supports are advanced, so that they completely cover the second, third or succeeding shafts that have been cut. Thus, there is always at least a single line of roof supports from the central work area along the entire work face to the radius R, adjacent to the advancing continuous miner. As the mining machine advances, the extensions on the roof supports are extended to protect and hold the roof until the next cut is made. Thus, men and equipment are protected at all times and stages of operation by roof supports and supplied with clean fresh air.

In this invention, the long wall starts essentially as a long radial, or almost radial, wall. One end of the wall is always at the center shaft, and therefore, material must be carried only for a maximum distance of R, from the working face to the point at which it can be raised to the surface, creating the absolute minimum distance, and least handling.

A second feature of great importance is that back of the roof supports, or chocks, the ends of the chocks opposite to that in which the shaft is advanced, there is a flexible curtain, wall or air seal member, which forms a curtain wall, continuous from the central workroom and shaft out to the radius R. This divides and seals the working shaft area from the preworked shaft area in which the roof is caving.

This radial curtain wall acts as a dividing wall between fresh air which is drawn or forced down the central shaft. The fresh air moves radially out through the last shaft being cut, past the working face, picks up all the dust and gas, and as contaminated air carries it out to the outer wall at radius R, around the last chock, which may be spaced away from the outer wall, so that the air can move around the last chock and back behind the curtain wall, to the center of the work area, and up a second shaft to the surface. The air can be forced down the central shaft or can be evacuated up the second shaft or in any selected manner so long as the clean air is kept separate.

It will be clear also that when the actual mining operation is close to the inner end of the working face, a portion of the curtain can be removed to by-pass the outer end of the shaft.

BRIEF DESCRIPTION OF THE DRAWINGS

These and other objects and advantages of the invention and a better understanding of the principles and details of the invention will be evident from the following description taken in conjunction with the appended drawings in which.

DESCRIPTION OF THE PREFERRED EMBODIMENT

Figure 1:
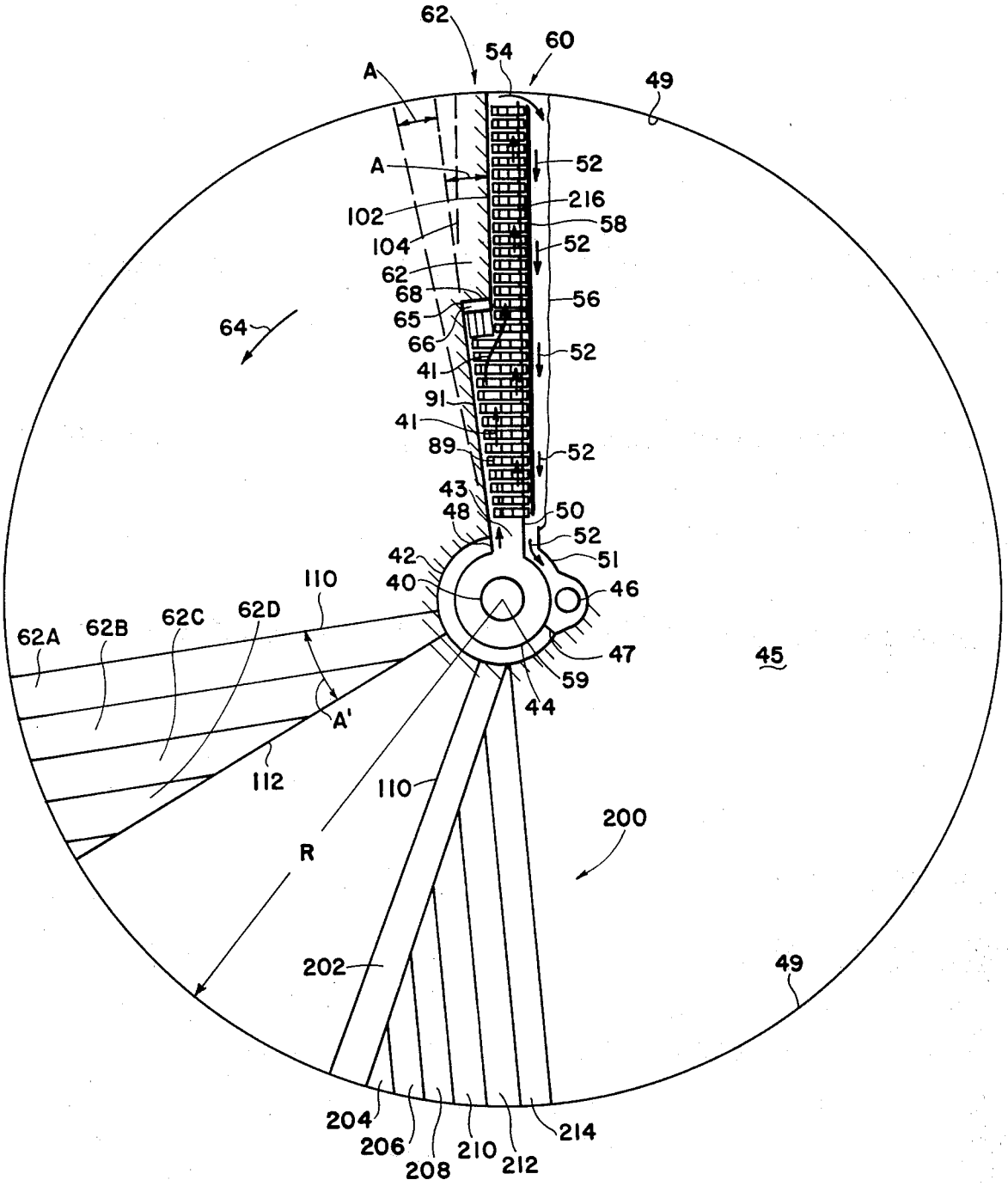
FIG. 1 is a modified copy of FIG. 2 of Ser. No. 761,797 and represents in plan view one embodiment of this invention.
Figure 3:
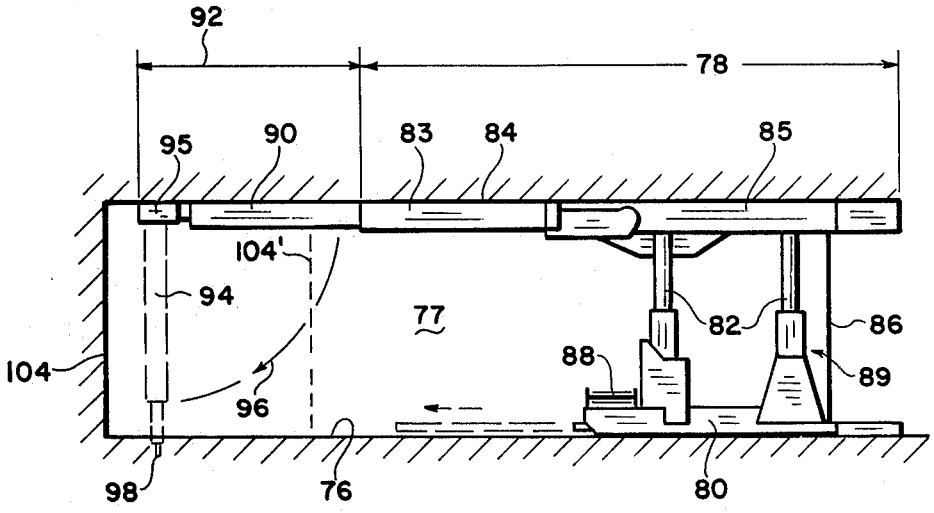
FIGS. 2 and 3 are similar to FIGS. 3 and 4 of Ser. No. 761,797.
Figure 2:
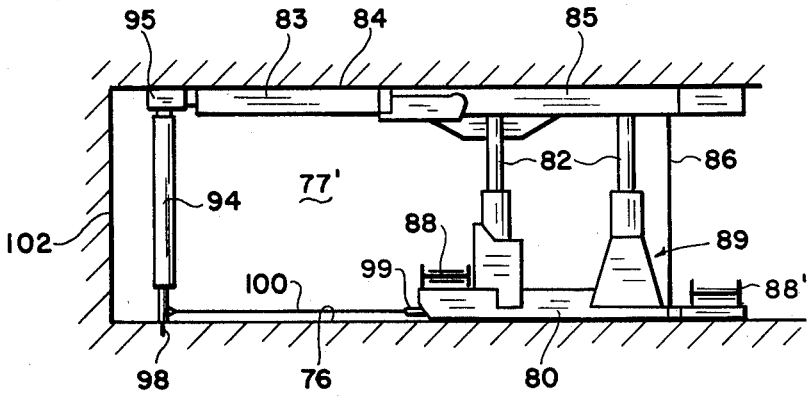

FIGS. 1, 2, and 3 of this application have been copied from my co-pending application, and reference is made to that application for further detail and background information.

Referring now to FIG. 1 which is based on FIG. 2 of Ser. No. 761,797, there is indicated the general procedure by which an underground mineral seam is mined according to one aspect of this invention. It comprises drilling first a vertical or slope shaft 40 from the surface of the earth down to the depth of the more or less horizontal mineral seam. It is intended to remove a circular slab of the mineral of a radius R (of many hundreds of feet) in the form of a cylinder of wall 49, leaving a room of area 45, of mineral to be removed. The shaft 40 is large enough for men and equipment to be lowered. Equipment may be lowered in unassembled form and assembled in a workroom 42 created at the bottom of the first central shaft 40.

A first horizontal radial shaft 60 is dug or mined from the central shaft 40, or from the central workroom 42, radially outwardly to the radius R and the wall 49 which will be the limit of the operation. This radial shaft can be cut by any selected conventional method which will include the work area and space for movement of men and material. When cut, it provides a first long wall 102, which is substantially radial from the central shaft 40 to the wall 49. As the first radial shaft is drilled, chocks 89 are successively set. When the shaft has been advanced to 49, a second long wall 41 is started at an angle A clockwise or counterclockwise (as shown) or both from the first wall 102.

Although any desired method of advancing the first wall can be used, it is preferred to use a continuous miner 66 of conventional design, which has a long cutting cylinder which may be of any desired width; for example, of the order of 8 to 12 feet wide, so that it advances the wall 9 to 12 feet and of sufficient height to provide a roof 84 and a floor 76, FIG. 2, which presumably will correspond to the upper and lower interfaces of the mineral seam. Of course, the cut may be made above and/or below so that together with the seam, to provide sufficient height for machinery and men, etc.

The continuous miner indicated by the numeral 66 starts at the central workroom 42 and advances outwardly along a radial line 91 until the working face 68 begins to depart from the first wall 102. In other words, the second wall is now being advanced by the width of the cutter 66 and the short wall 68. The direction of the continuous miner 66 is then turned to be parallel to the first wall 102 and as it advances outwardly it will create a second wall 104 shown in dashed line, which is parallel to the first wall 102.

Figure 4:
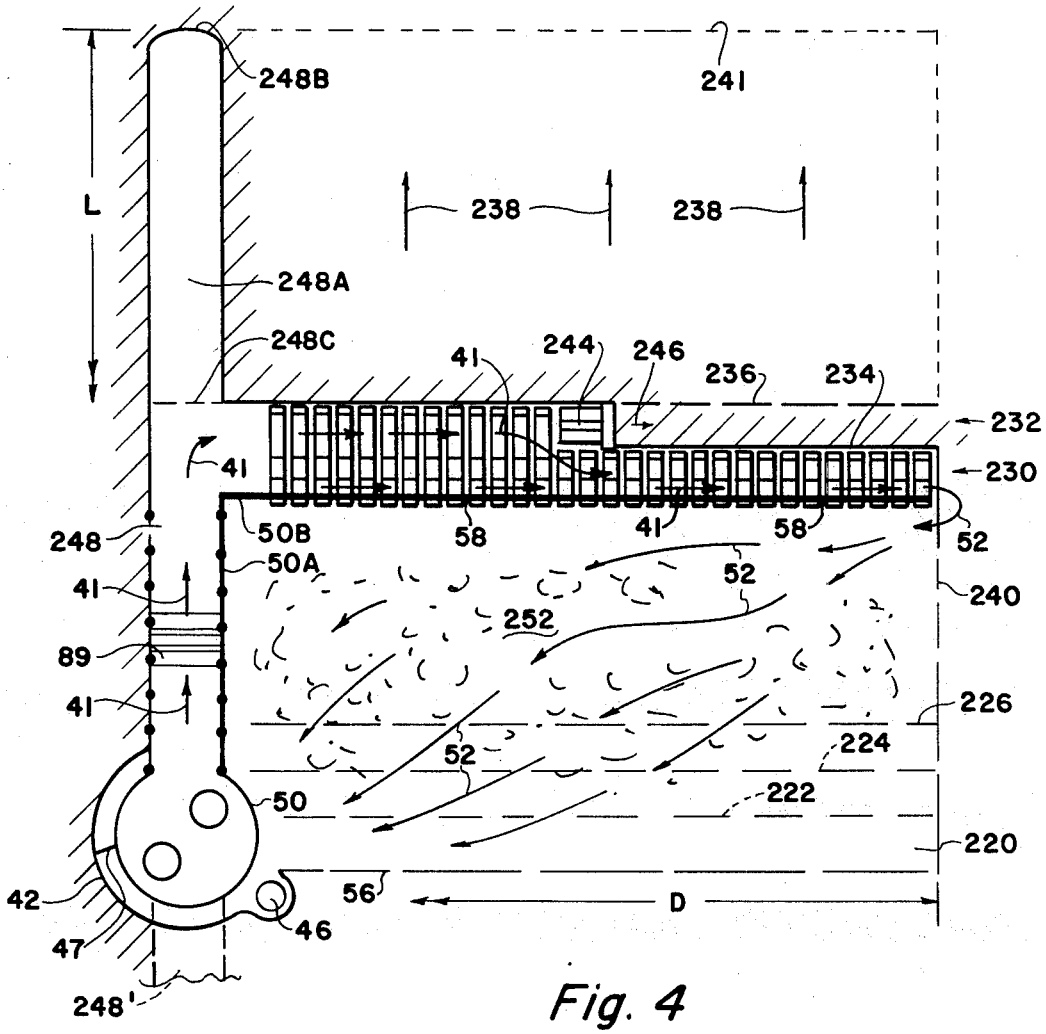
FIG. 4 represents schematically an embodiment of this invention in which a rectangular area is cut from a subsurface zone or seam of mineral material.

Referring now temporarily to FIGS. 2 and 3, which are identical to FIGS. 3 and 4 of Ser. No. 761,797, there is shown a section of the mine with a roof 84, a floor 76, and a first wall 102. A chock indicated generally by the numeral 89 has a base 80 which rests on the floor and it has four vertical cylinders based in a rectangle, which support a rigid structure indicated by numerals 83 and 85. Part 83 is a hydraulic cylinder which has rams 90 which can be extended as shown in FIG. 4. Incidentally, in normal operations, the vertical cylinder 94 is lifted in horizontal position under the part 83.

The dashed vertical line 104' represents in FIG. 3 the wall 102 in FIG. 3. In other words, if FIG. 2 represents the first shaft 60, the first wall 102 would be in the position of the dashed line 104'. Now as the continuous miner moves to the left and widens the width of the total shaft 1 and 2, the extensible portions 90 of the chocks are moved out as in FIG. 3 so that the roof is supported out to the line 104 or 65, close to or as far out as possible to the new wall 104.

The extended position from the base 80 out to the wall 104 is now greater than the width of the continuous mining cylinder and so the miner can be withdrawn through the opening between the wall 104 and the base 80 of the chock 89.

In other words, as the miner is deflected along and parallel to the wall 102, is provides a new long wall 104 which is faced by the width of the cutter cylinder and as it moves outwardly the chocks are extended to support the newly formed roof until the miner reaches the wall 49.

At that point, the miner is withdrawn back along the second shaft 62 to the first deflection point at which it was changed in direction from the angle A to be parallel to the first wall 102. It will be clear that the continuous mining machine can cut the face moving radially inwardly or outwardly.

In the next cut, the continuous miner 66 will move out parallel to the wall to the line at angle A and cut a complete radial wall out to the limit 49. There is now a new radial wall, and the cutter is brought back to the center workroom, and a new line at an angle twice the angle A from the original radial line 102, is started, and is continued as has been described.

Because of the scale of the drawing, it seems as though the second wall 104 is substantially the same as the radial direction at angle A. However, that is not necessarily the case. As shown in FIG. 1, if the angle A' is much larger than in the sector between the radial lines 110 and 112, for example, there could be considerably more parallel shafts 62A, 62B, 62C, 62D, and so on.

In the area 200 of FIG. 1, another way in which a sector can be mixed is indicated. A radial shaft 202 is first drilled, and successive shafts 204, 206 . . . 214 are drilled, all parallel to each other and at an angle A to shaft 202.

There is no attempt to limit the variety of geometrical patterns or directions (right or left) or direction of advance of cut (outward or inward) that may be devised. The important thing is that there is a long wall which may be straight or curved starting from the central shaft at the center 40, and the workroom 42 out to the outer wall 49 at radius R. This wall can be advanced in a clockwise or counterclockwise direction as shown by arrow 64, or in any selected manner such as by long wall mining technique, short wall mining technique, or other modern cutting techniques.

In further connection to FIG. 1, there is shown a line 58 (which in FIGS. 2 and 3 is under the protective roof of the chocks and indicated by numeral 86), which represents a flexible curtain separating the work space under the chocks, from the worked-out space behind the chocks, and between the chocks and the fallen roof indicated by numeral 56. The area between 56 and 58 is part of the mined out area, sometimes described as the COB. The material 45 to the right of line 56 is the virgin material wall of the original radial cut.

In the workroom 42, there is provided a cylindrical wall 44 which may be masonry wall or other proven material from floor to ceiling which has an opening 43 which faces the work shaft 60, 62, etc. The cylindrical wall 44 has one wing 48 which seals against the wall 42 of the workroom. It has another wall 50 which connects to the curtain hanging under the chocks, indicated by the line 58. Thus, air which moves down the shaft 40 in accordance with arrows 41, and out toward the wall 49 passes around the last chock near the outer wall 49, and returns in accordance with arrows 52 in the space between the flexible curtain 58 and the fallen rock 56, which was cut by the first shaft out to the radius R. The flow of contaminated air indicated by numeral 52 passes into the annular space 51 between the outer wall 42 of the work room and the wall 44, and then passes up to the surface through the second vertical shaft 46, or by suitable conduit, for example, inside the main shaft 42. This drive of fresh air 41 is forced to, and past, the work face where it picks up the dust formed and moves out to the radius R of the wall 49 and back behind the curtain 58 to the second vertical shaft 46 to the surface. The air can be driven or pulled by conventional methods. This suction, or force, or both, will cause fresh air to move into the mine and to flood the face with fresh air, and carry all the pollution and dust and gas out to the wall 49, and back to the surface by means of the path along the walls 58 and 56 and up the vertical shaft 46, which is entirely separate from the path of the fresh air.

The first wall is advanced by cutting away at least part of the first wall, which can be done by any means such as a continuous miner, for example. As the miner moves outwardly, the chocks are extended as shown by extension of the rams 90 and they are also moved laterally as may be required to fully cover the roof which is exposed by the passage of the miner.

The cut mineral can be transported by means of a conveying system supported on the base 80 of the chock.

The continuous curtain 86 shown in FIGS. 2 and 3 is continuous between the chocks so that even though they are moved laterally with respect to each other, there is a continuous dividing wall between the space on the front side of the chocks and the space on the back side of the chocks, or roof supports.

What has been described is a novel method of mining a large underground seam of mineral which has several important benefits. It provides a method of mining as large an area as desired in a circular cylindrical fashion. The access to the work area is by means of a conventional central shaft through which men, materials, and fresh air are passed. Starting with a first radial work shaft which is cut by any conventional method which provides a long wall which is essentially in a radial direction, this wall is advanced in a clockwise or counterclockwise direction as desired. Roof supports, preferably of hydraulic design, or chocks, which are sequentially positioned behind a continuous miner and are extended as necessary to cover the newly exposed roof. As the continuous long wall is advanced the continuous miner is brought back, or cuts the wall back, and the new angle is set to advance the wall more or less continuously in a radial direction until a complete circular passage of the wall has been carried out.

As the wall advances, the chocks which support the roof are advanced, and the unsupported roof is then permitted or forced to collapse. The subsidence of the roof material at least partially fills the space that has been mined. When a complete traverse, or the complete revolution of the working face is made, the entire cylindrical area and volume has been mined, and the equipment can be retrieved through the central shaft or shafts.

There are several important features of this type of mining such as the following:

1. Completely eliminates human exposure to roof falls;
2. Fresh air is continuously supplied to the working face, and contaminated air is continuously carried away. There are no areas of stagnant air;
3. Virtually 100% recovery of material;
4. Shortest possible route for supplying and delivering materials, supplies, equipment, power, services, personnel, etc.;
5. Instant and continuous control of all operations;
6. Less maintenance;
7. Safer—no intersections of stress points, no fire, minimum roof supports required, etc.;
8. Can follow the slope of the seam to greater slopes than in other methods; and
9. Eliminates the need for strip mining with its excessive damage to the environment.

The length of path required for the transported material and men from the mouth of the mine to the working face is reduced tremendously which reduces the cost of that equipment, cost of transport of material, and means for providing necessary services, and so on.

Another principal benefit is provided by the fact that clean fresh air passing down through the central shaft or shafts can move radially through the shaft at which the face is being advanced, and provide fresh air directly to the work face, and then carry the dust and pollution radially outward to the circular wall and back behind the chocks and the flexible curtain to a second vertical shaft and thus to the atmosphere.

While the drawing shows a continuous curtain wall from the central area to the outer wall 49, it will be clear that when the operations are close to the start of the radial shaft, a section of the curtain wall 58 may be removed, such as at point 216, to permit the flow of contaminated air to bypass the outer end of the shaft and to return directly to the central area.

It will be clear that the "radial" pattern of cutting can be varied from narrow pie slices, to the "radial plus parallel" pattern described above. The important factor being that the long wall starts at the central shaft and ends along the outer circular wall. The particular shape of the intervening path of the working face is not critical. However, a straight wall is most convenient, and only a single line of roof supports is needed.

Also, if the lower interface of the mineral seam is not precisely horizontal, the radial shaft would follow the slope of the base of the seam.

The presence of the radial flexible curtain or closure wall is important since it provides the optimum method of providing a continuous flow of fresh air to the working face, while carrying the contaminated air with its dust and gas by a separate route to a second central shaft to be processed and released to the atmosphere.

It is desirable, therefore, to set up the closure wall under the roof supports as the supports are set up, while drilling the first radial shaft. In other words, as the shaft is extended and additional roof supports are added, the closure wall is also extended. Thus, the operators of the mine equipment are never working beyond their clean air supply.

While the object of this mining method is to recover as much as possible of the mineral or other material, such as fine clay, rock, ore, etc., with the removal of as little of the overburden or underburden as possible, it may be necessary or desirable to overcut or undercut the seam in order to provide an improved environment or space for desired machinery, etc. It will be clear also that this waste rock, after separation of the mineral can be used as fill in the space behind the curtain wall. The waste rock can be moved to the desired location by means of conveying systems.

While I mention "seam", the term is understood to include as well, part of the overburden and underburden as desired.

While I mention "mineral", the term is intended to include coal, ore of any type, rock materials, fire clay, and any and all subterranean materials that it may be desired to mine.

DESCRIPTION OF FURTHER EMBODIMENTS

Figure 6:
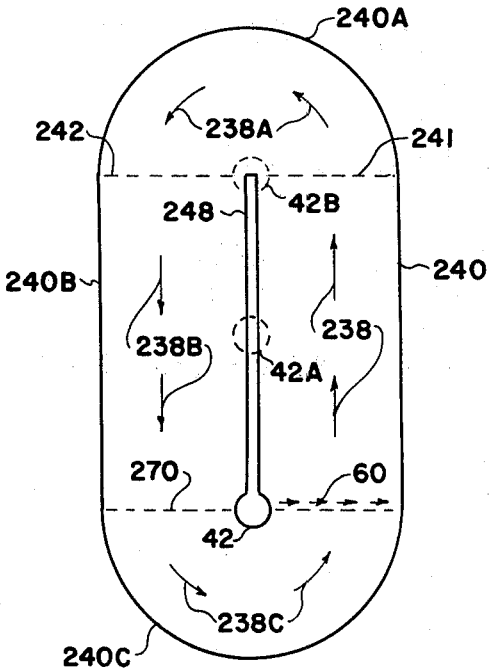
FIG. 6 illustrates schematically the overall mining operation illustrated by FIGS. 4 and 5.
Figure 5:
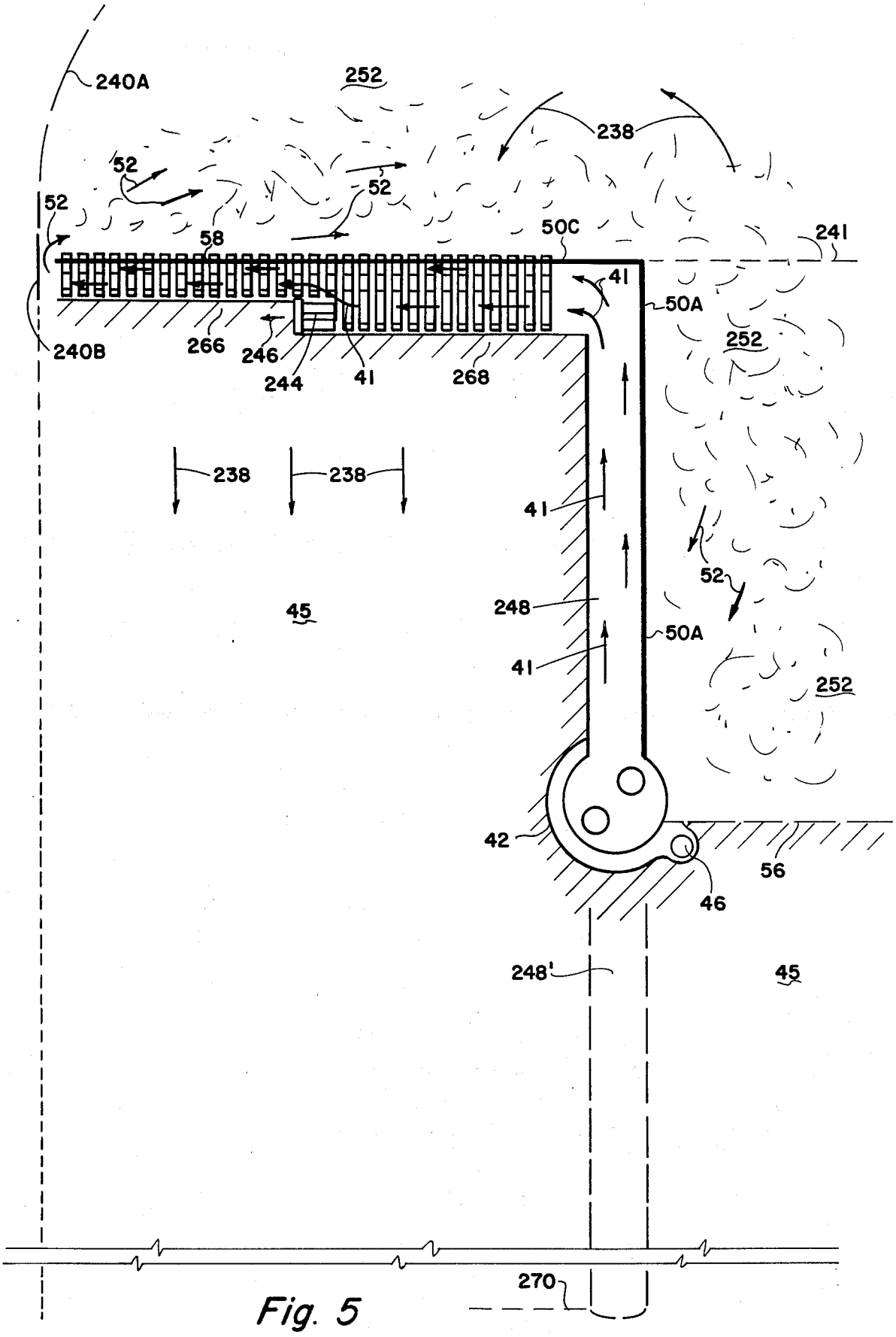
FIG. 5 illustrates schematically an extension of the method by which the material can be mined as indicated in FIG. 4.

In FIG. 1, and in the parent application Ser. No. 761,797, the application of this invention to mining a circular volume of the mineral seam was fully described. It will be clear from the part of FIG. 1 indicated generally by the numeral 200, that the advance of the leading wall of an existing shaft can be by means of a mining operation that removes material from the leading face and provides a new face which can be at a selected angle to the original first face, or first wall, or may be parallel to it. Applying this thought further, there is illustrated in FIGS. 4, 5, and 6 another embodiment of the invention in which the area mined is a rectangular one and is carried out by a succession of parallel, contiguous wall cuts so that the original shaft can be widened successively to form a large rectangular area. As the wall is advanced by cutting parallel faces, and as the roof supports or chocks are advanced to support the roof uncovered, the old roof becomes unsupported and is permitted to slump or cave as previously described.

In FIG. 4 the wall indicated by numeral 56 is the existing wall 56 of the first radial shaft shown in FIG. 1. The first face 222 of the original radial shaft 220 is advanced to a new face 224 by starting at the workroom and cutting away the face 222 by any known or desired mining means, but preferably by a continuous miner as previously described. As the face advances from 222 to 224 to 226 and so on up to a shaft 230, an additional shaft indicated as 248 is required for the handling of materials and machinery as the successive shafts from 220 to 230 are cut. This shaft 248 is generally at right angles to the shaft 220 and can be cut at the start of operations, if desired, and extended to a total length L from the central workroom 42, or conversely, the shaft 248 can be advanced little-by-little as the new faces and new shafts up to 230 are cut, or already present from an existing mine, and so on.

For example, after the shaft 230 is completed, the mining machine is brought back to the shaft 248 and advances to cut a new wall 236 or cuts wall 236 while moving inward. FIG. 4 shows that this new wall 236 is approximately half-cut out to the distance D, to the outer wall 240, of the excavation.

Having completed the shaft 230 with the first wall 234, the mining machine is moved ahead along the shaft 248 and faced in a direction parallel to the arrow of advance 246 and starts to cut the wall 234. As the cutter advances in the direction 246, the extensions of the chocks are pushed out to support the new roof as has previously been described in Ser. No. 761,797 and the chocks behind the mining machine 244 are extended while those farther down the original shaft 230 are still not extended.

As the shafts move from 220 to 230 and then to 232 the wall 50 shown in FIGS. 1, 4, and 5 is extended to 50A and 50B, where it seals up to the end of the curtain wall 58, which hangs behind the row of chocks and forms an air seal between the space below the chocks in the active shaft and the space 252 behind the chocks wherein the roof has been allowed to slump or cave.

As previously described, fresh air is delivered down the vertical shaft 42 and flows in accordance with arrows 41 down the shaft 248 and into the shaft 232 being worked. The fresh air then flows past the working face and picks up dust and contamination, and carries it down the shaft 232 and, as arrows 52 show, flows back over the cut-away area 252 to the shaft 46 where it moves up to the surface.

The shaft 248 requires roof supports which can be of a more permanent nature since the shaft 248 is required for a long period of time as the working face moves from 56 up to the end 248B, and so on. If the shaft 248 is cut and roof supported before the mining of the seam is carried out, then it may be desirable to hang an air screen 248C over the unused portion of the shaft 248. This simplifies the control of fresh air down the shaft 248 and into the working area.

Arrows 238 indicate the direction of advance of the long wall 236 of shaft 232 as the wall is advanced by the previously described steps until it gets to the position 241.

Referring now to FIG. 6, there is shown a projected elongated oval-type of excavation of the mineral seam that started with an original shaft 60 from the workroom at 42 moving parallel to the arrows 238 along the shaft 248 until the working face reaches 241. At that time, the cut is made in advancing the wall 241 will follow the procedure described in terms of FIG. 1. Thus, the face advances in accordance with arrows 238A and a semi-circular area having an outer wall 240A will be formed to reach a new face 242.

At that time, the position of the working face will be as indicated in FIG. 5, where one longitudinal rectangular volume, and one semi-circular volume 252 have been cleared of desired mineral. The process of advancing the face from 266, for example, to 268 is substantially the same as it was in advancing the face from 220 to 232. The wall 50A is extended to the position of 241 and then at right angles again to join up with the screen 58 behind the line of chocks leading to the face 266. As before, air supplied down the vertical shaft 42 advances in accordance with arrows 41 down the shaft 248 and then into the shafts 266 and 268 around the curtain wall 58 and in accordance with arrows 52 to flow through the entire volume 252 of cut material, and back to the shaft 46 where it moves to the surface.

By the process outlined, the wall 268 is advanced stepwise in a direction of arrows 238 to cut away the mineral material 45 and to advance the area 252 of cut material to 270.

Thereafter, the advance of the front is again carried out at an angle, instead of being parallel to the existing front. This cuts out another semi-circular volume of material as shown in FIG. 6, eventually reaching the original wall 56 of the first shaft 60, at which time the entire area outlined has been cut away.

It will be clear that if the mineral seam outcrops and there is a work surface prepared to provide a work area at the level of the seam, the shaft 230/232 can be directed inwardly on the outcrop, and a manner of procedure illustrated in FIG. 4 or 5 can be followed to cut out a rectangular or arcuate volume with the product material and waste, etc. carried to the work surface as illustrated in FIGS. 4 and 5; and thus out of, and away from, the work area to a stockpile by conventional means.

There is also another possible application of this method where the mineral seam is shallow, and wherein present practice comprises strip mining, or the operation of removing the overburden entirely, and using surface digging machinery to remove and transport the mineral. This type of surface mining is common in the mining of coal deposits, for example.

However, one of the worst problems associated with this manner of surface mining is that the overburden must be removed, stacked and then replaced after the area has been mined.

Figure 7:
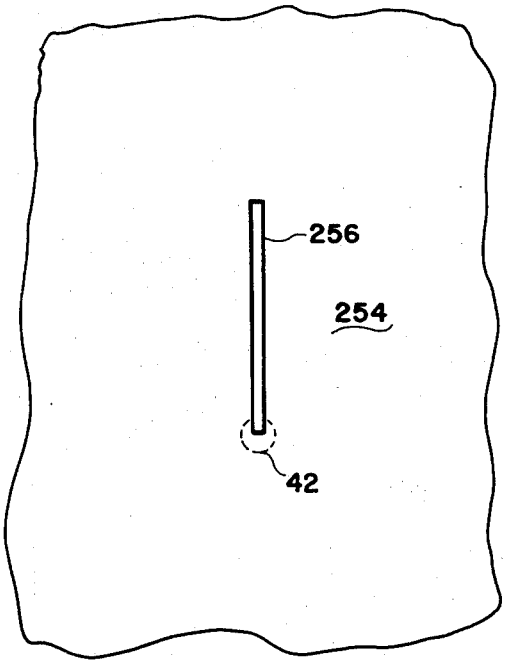
FIG. 7 illustrates how the access to the subsurface mineral seam can be provided by a bar cut from the surface down to the mineral seam.

In accordance with this invention, it would be necessary only to uncover a small area such as bar cut 256 as illustrated in FIG. 7. Access can also be by means of a short sloping road providing access to the work station, so that machinery and personnel could be placed at the depth of the seam to initiate a procedure such as that illustrated in FIGS. 4 and 5.

Figure 8:
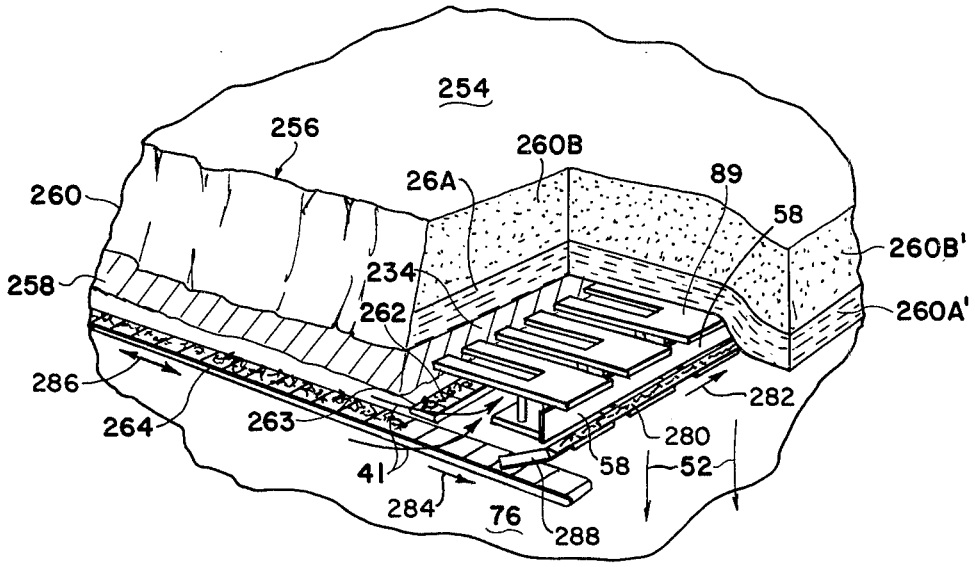
FIGS. 8 and 9 illustrate the application of this invention in accordance with FIGS. 4, 5, and 6, to a shallow mineral seam which would normally be strip mined, by removing the entire overburden above the seam, but is mined according to this invention by simply digging a narrow bar cut from the surface to the mineral seam.
Figure 9:
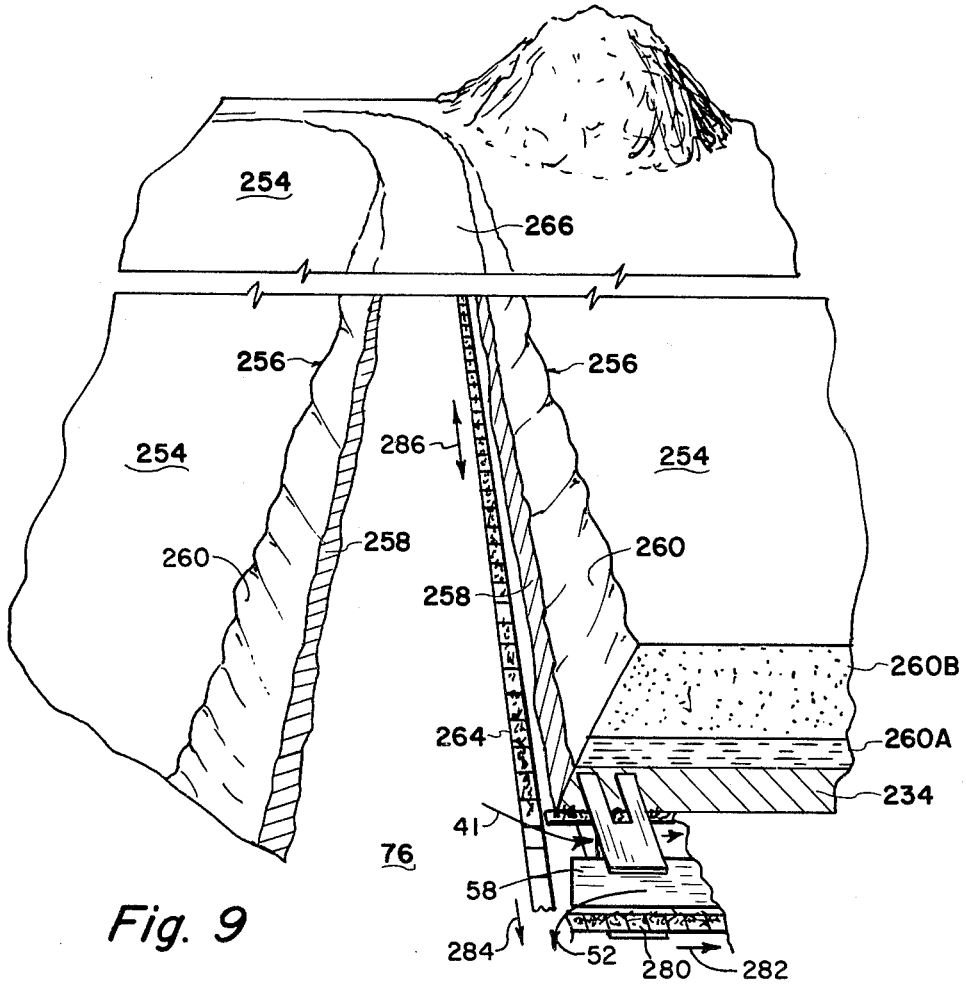

Such an operation is indicated in FIGS. 8 and 9, where a bar cut 256 is shown cut to the depth of 76 of the mineral seam 258, by any conventional means, such as by a drag line, for example. The type of bar cut is illustrated in FIG. 7 and comprises a cut 256 in the surface 254 of the earth. At a selected point along the bar cut, such as at one end or as indicated in FIG. 6 at some central portion 42A or at the other end 42B, the workroom or work station can be set up, which serves to start the mining operation.

In the illustration of FIG. 9, the bar cut 256 is cut to the depth 76 of the mineral seam 258 having a mineral overburden 260, having component geological formations 260A and 260B, for example. FIGS. 8 and 9 show the drilling in progress in accordance with FIG. 4 where the working shaft is at right angles to the cut 256. Shown are the roof supports 89 placed along a cut wall 234 and extending inward and under the overburden. At the back end of the chocks 89 is the curtain 58 that separates the area under the chocks from the cut area behind the chocks, as has been described. Fresh air is drawn into the space under the chocks in accordance with arrows 41 by means not shown but well known in the art, and this air as has been explained, flows along the shaft under the chocks, around the end of the curtain 58, and back in accordance with arrows 52. The flow of contaminated air 52 is separated, by means well known in the art, including the possible use of screens and so on, so that there is no chance of contaminating the fresh air 41 by mixture with the contaminated air 52. Also shown are conveyors, one line 263 down the working shaft and the other one 264 directed at right angles down along the bar cut 256. It will be seen in FIG. 8 that the overburden formations 260A' and 260B have been allowed to slump and cave to the position 260A' and 260B' behind the curtain closure wall.

FIG. 9 shows this operation from a little different point of view. The floor 76 of the cut 256 is shown as extending some distance and ends in a sloping roadway 266 up to the surface 254 of the earth. Thus, trucks or other conveying means can be brought down along the road 266 to the floor of the bar cut 76 to load the cut material. It will be clear that only a small opening through the overburden is required, as in FIG. 1.

In summary, the invention which has been described in the original application Ser. No. 761,797 and in this application covers two principal advances in mining procedure.

One advance lies in the use of a vertical shaft down from the surface to the mineral seam and carrying out a long wall mining method with a single row of movable roof supports, so that a single shaft is being worked with the leading face being advanced row by row. The successive advances of the leading face can be parallel to the existing face or at an angle, thus permitting the excavation of substantially rectangular, circular, or combination areas from which material is removed from the seam.

The second advance lies in the design of an air supply and recovery system which insures that air is supplied directly from the surface to the shaft, the face of which is being worked. This flows along the shaft from the end nearest to the source of air, out along the shaft past the working face, and around the end of a curtain wall which separates the work area under the roof supports or chocks, from the space back of the roof supports. The contaminated air flows behind this curtain and back to the shaft or conduit means by which it is carried to the surface. At all times there is a wall separating the flow of fresh air from the flow of contaminated air, and the fresh air is directed solely to the working face, thus a more rapid change of fresh air is provided than can be provided in conventional mining systems.

Where the thickness of the seam is less than the height of the cut necessary for men and machines for working the face, it may be necessary to cut a large amount of waste rock, more than can be disposed of at the surface. This material can be returned to the COB or worked over area 252, by conventional conveyor means immediately behind the curtain walls.

This is shown in FIGS. 8 and 9 as a conveyor 280, preferably supported by the chocks, but not necessarily so. In general, the conveyor 280, moving in the direction of arrow 282 would be protected from slumping of the roof by the tops of the chocks, and would be advanced as the chocks advance.

Waste material can be off-loaded from the conveyor 264, shown by arrow 286 as capable of running in either direction. It would carry mineral out of the mine to the surface, and carry waste rock, etc. into the mine. This waste would, by means 288, be loaded onto 280 and moved into the shaft behind the chocks. Means would be provided, as is well known in the art, for off-loading waste material from the conveyor 280 at selected distances along the shaft, behind the curtain.

These conveyors should include means to selectively dump from the conveyor at points along its length. The conveyor for disposing of waste material can conveniently be mounted on the back end of the base of the chocks, so that the material is placed immediately behind the curtain wall, before the roof has a chance to slump.

While I have described the mined-out areas as rectangular or circular, it will be clear that the actual areas may vary somewhat from such specific shapes, as required by conditions at the mine, such as irregular termination of the seam or thinning of the seam or fault lines, and so on. The point, however, is that I have shown how to advance the wall of the shaft to a parallel wall, or to an angular wall, and by choice of a combination of angular and parallel advances, any desired shapes of cut out areas can be provided, which are combinations of rectangles and sectors, by forming shafts which are selected combinations of straight and-/or arcuate elements.

Referring to FIGS. 2 and 3, there is another important feature which has not been previously used or described. While the hydraulic chocks illustrated are conventional commercial devices, what is not shown is some very heavy equipment, including long heavy beams which are positioned in the space 77 and which are anchored on adjacent chocks, and with hydraulic cylinders serve to move the chock to the left, such as from the configuration of FIG. 3 to that of FIG. 2.

As the chock 89 is moved to the left, the port 95 stays where it is, and the shelf 90 slides into the support 83 to arrive at the position of FIG. 2.

Normally the cylinder 94 is carried up under the shelf 90 and serves to extend/withdraw the shelf 90 from and to the port 83.

As part of this invention, I show a swivel at 95 that permits the cylinder 94 to rotate about 95 and to be lowered to the position shown in FIG. 2. By using the hydraulic force of the cylinder and a hardened point 98, the cylinder/piston is anchored to the floor, as shown in dashed line in FIG. 3. Now by using a tension member 100 tied to 98 and the piston 99 of a hydraulic cylinder mounted in the base 80 of the chock, pulling on the anchored end of 100 at 98 will cause the chock 89 to be pulled to the left into the shortened position shown in FIG. 2.

By using a compression member instead of a tension member at 100, the chock can equally well be pushed to the right, if such was necessary.

Thus, by a very simple improvement in apparatus, the rapid advance of the roof supports as chock 89 is possible.

The long flexible curtain wall is continuous throughout the length of the shaft and serves to provide an air seal between the work space under and in front of the chocks from the COB area behind the chocks. Of course, this curtain need not be a single piece of material but is preferably made in pieces which can be attached to the top and base of the chocks. This is shown in FIGS. 2 and 3 by line 86. In view of the vertical extensibility of the chocks, this curtain can be made of flexible or sliding panels, and/or horizontally accordian pleated sheets, and so on. Similarly, narrow vertical panels (not shown) can be attached between the chocks, such as illustrated in FIGS. 5 and 6 of Ser. No. 761,797.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. The method of mining a selected area of a subterranean mineral seam, comprising;

(a) preparing a workroom or station at a selected point in said subterranean mineral seam;

(b) drilling a shaft in said seam, in a selected direction from said workroom or station;

(c) as material is removed from said shaft, supporting the roof by means of movable roof supports, or chocks, said supports arrayed in spaced relation along said shaft and oriented in the selected first dimension, in which said shaft is to be enlarged;

(d) as the roof supports are placed in position, providing a continuous curtain closure wall, or air seal, behind said roof supports;

(e) providing a supply of clean air to said work station and causing it to flow along said shaft under said roof supports, around said curtain closure wall, and back of said closure wall to said work station; and (f) providing means for disposing of the contaminated air returned to said work station.

2. The method as in claim 1, including the additional steps of;

(a) after said shaft is drilled to a selected distance D from said work area, cutting back at least a part of the first wall of said shaft, in the direction in which said shaft is to be widened;

(b) as the widening operation proceeds along said shaft, moving said roof supports forward to cover the new roof, and with said supports, moving said curtain wall;

whereby as said roof supports are moved forward, to support new roof, the old roof is allowed to fall and the overburden to slump.

3. The method as in claim 2, including the steps of;

(a) cutting back at least part of the first wall of said shaft to form a second wall, which is at an acute angle to said first wall;

whereby the shape of the area of the seam from which material has been removed is substantially a sector of a circle.

4. The method as in claim 3, including the steps of;

(a) repeating the step of cutting back the existing lead wall of the widened shaft to form a new lead wall, which is at an acute angle to the existing lead wall, until a substantially circular area has been cut away.

5. The method as in claim 2 including the additional step of:

(a) replacing waste material in the space behind said curtain wall prior to slump of the roof.

6. The method as in claim 1, including the steps of;

(a) cutting back the first wall of said shaft to form a second wall, which is parallel to said first wall;

whereby the shape of the area of said seam from which material has been removed is substantially a rectangular area.

7. The method as in claim 1, including the step of providing a vertical or slope shaft from the surface of the ground to said work station in said subterranean mineral seam.

8. The method as in claim 1 including the additional step of providing access to said work station in said subterranean mineral seam from an outcrop of said seam.

9. The method as in claim 1, including the step of providing access to said work station in said subterranean mineral seam by an open cut through the overburden from the surface.

10. The method as in claim 1 including the steps of;

(a) making a long narrow block cut through the overburden to a working floor near the bottom of said mineral seam; and (b) making at least one area of mineral removal bordering one edge of said block cut.

11. The method as in claim 10, including the additional step of;

making a second area of mineral removal bordering the second edge of said block cut.

12. A method of mining a selected subterranean mineral seam for removal of said mineral over a selected area of selected dimension and shape, and for minimum distance of transport of supplies and products, and optimum delivery of fresh air to the work face, comprising;

(a) drilling at a selected point on the surface of the earth, down to the vicinity of said selected seam of said mineral, at least a first large diameter vertical or slope shaft, and forming a workroom at the base thereof;

(b) providing means for carrying clean air down to and means for carrying contaminated air up from said seam through said at least one shaft;

(c) drilling a first radial shaft in said seam from said work room in any selected direction to any selected distance D, in any conventional manner, using movable roof supports, said supports positioned at successive radial distances from said workroom with their movable portions directed at right angles toward a first wall of first radial shaft;

(d) after said first radial shaft is drilled to said selected distance D, widening said radial shaft using any selected mining method, and cutting back at least a pair of said first wall, to form a second wall; and (e) carrying the material removed along said line of roof supports to said workroom and to the surface.

13. The method as in claim 12 including the additional steps of;

(a) as said first radial shaft is being drilled, providing a curtain closure wall, or air seal, along the back side of the line of roof supports;

(b) providing means for directing said fresh air from said workroom radially out along said first radial shaft under said line of roof supports, around the end of said curtain closure wall and back in the space between said curtain closure wall and the back wall of said first radial shaft; and (c) providing means to carry said contaminated air from behind said curtain wall, through said contaminated air-carrying means to the surface of the earth, through said at least one vertical or slope shaft.

14. The method as in claim 13 including the additional steps of:

(a) continuing to widen said radial shaft by using any selected mining method to cut back an additional part of said first wall and said second wall, as desired, to form a third wall;

(b) moving said roof supports forward toward said second and third walls to support the new roof exposed;

whereby the old roof in the space behind the roof supports and said curtain closure wall will be widened; and (c) permitting the roof to fall in the space behind said curtain closure wall.

15. The method as in claim 14 in which the shape of the area from which said mineral is removed is approximately a sector of a circle with said workroom at the center of said circle.

16. The method as in claim 14 in which the shape of the area from which said mineral is removed is approximately a semicircle, with said work station at the center of the semi-circle.

17. The method as in claim 14 in which the shape of the area from which said mineral is removed is approximately a circle with said work station at the center of the circle.

18. The method as in claim 14 in which the shape of the area from which said mineral is removed is a selected shape made up of a plurality of approximate sectors and/or rectangles.

19. The method as in claim 12 in which the direction of said second wall is at a selected small angle with respect to said first wall.

20. The method as in claim 12 in which the direction of said second wall is parallel to said first wall.

* * * * *